US005950329A

United States Patent [19]

Lehtinen et al.

[11] Patent Number: 5,950,329

[45] Date of Patent: Sep. 14, 1999

[54] METHOD OF AND APPARATUS FOR DRYING A FIBER WEB

[75] Inventors: Jukka Lehtinen, Tampere; Elias Retulainen, Kulju, both of Finland

[73] Assignee: Valmet Corporation, Helsinki, Finland

[21] Appl. No.: 08/982,145

[22] Filed: Dec. 1, 1997

[30] Foreign Application Priority Data

Dec. 10, 1996 [FI] Finland ..... 964938

[51] Int. Cl.[6] ..... D21F 5/00; F26B 7/00

[52] U.S. Cl. ..... 34/392; 34/452; 34/454; 34/71; 34/95

[58] Field of Search ..... 34/392, 417, 419, 34/449, 452, 454, 71, 95, 116, 117, 124; 162/206, 207, 359.1, 360.3

[56] References Cited

U.S. PATENT DOCUMENTS 4,461,095 7/1984 Lehtinen ..... 34/73 X
4,506,457 3/1985 Lehtinen ..... 34/73 X
4,622,758 11/1986 Lehtinen et al. ..... 34/392
4,958,444 9/1990 Rautakorpi et al. ..... 34/71
5,799,409 9/1998 Chau-Huu et al. ..... 34/117

FOREIGN PATENT DOCUMENTS 9611300 4/1996 WIPO .

*Primary Examiner*—Henry Bennett
*Assistant Examiner*—Steve Gravini
*Attorney, Agent, or Firm*—Ladas & Parry

[57] ABSTRACT

The invention relates to a method of and an apparatus for drying a fiber web, whereby the fiber web (5) is dried in a cylinder drying unit (12) and in a band drier unit (11). The cylinder drying unit (12) and the band drier unit (11) are arranged one above the other. A considerable space saving is then achieved and the building costs remain rather moderate. Simultaneously, a remarkable addition to the drying capacity is achievable by moderate investments by means of existing apparatuses, for instance. (FIG. 1)

8 Claims, 2 Drawing Sheets

METHOD OF AND APPARATUS FOR DRYING A FIBER WEB

Figure 1:
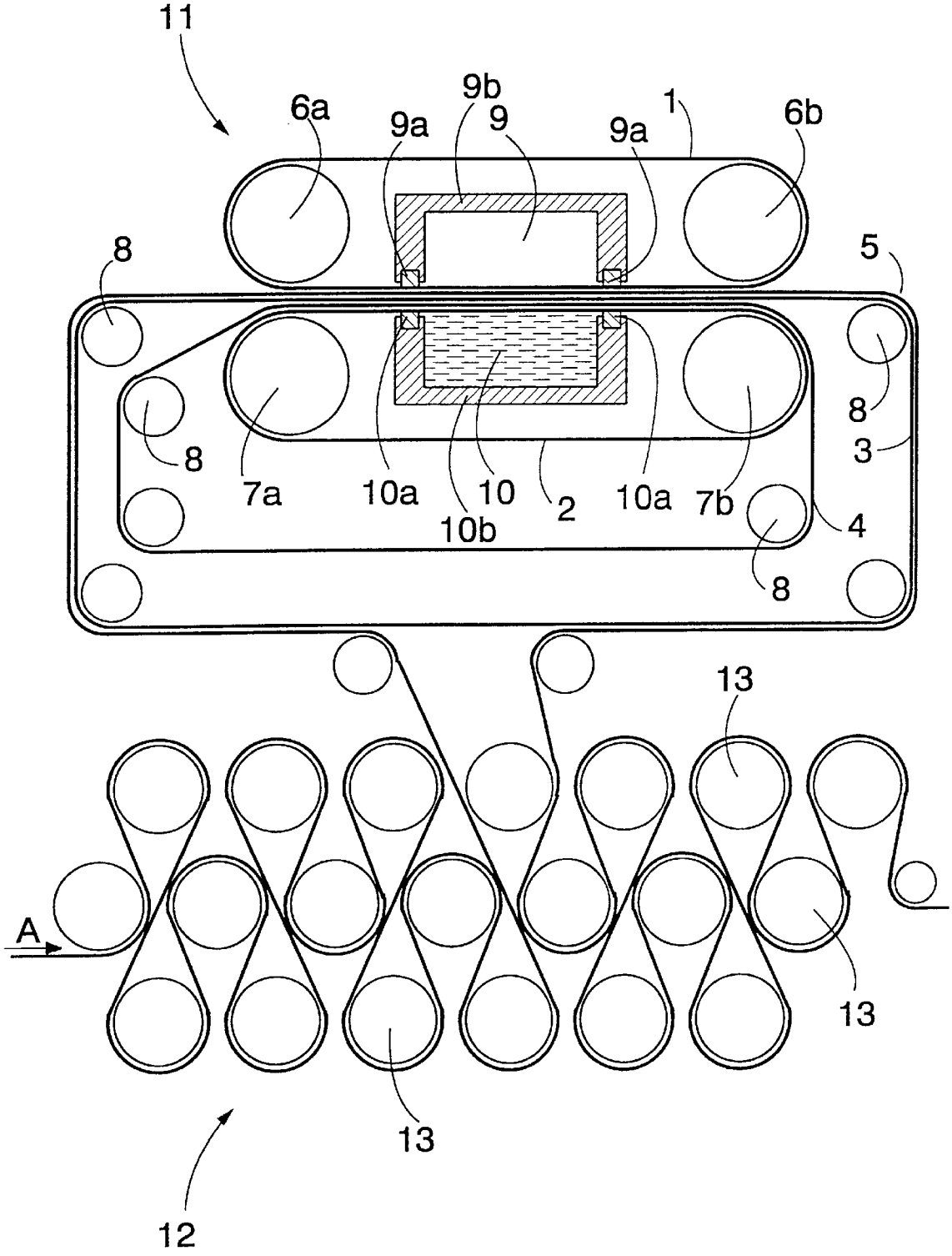

The invention relates to a method of drying a fiber web, in which method the fiber web is dried by means of drying cylinders in a cylinder drying equipment or unit, by pressing the fiber web against the surface of a drying cylinder with a felt or a drying wire, and in a band drier unit, comprising two endless air impermeable bands, first turning rolls, the first band being arranged to turn around the first turning rolls, and second turning rolls, the second band being arranged to turn around the second turning rolls, whereby the first band and the second band are arranged to run part of the way parallel with each other in such a way that they form a drying zone between them, the first band being heated and the second band being cooled, and whereby the fiber web and at least one felt or wire are led between the bands in such a way that the fiber web is in contact with the heated first band, and the felt or the wire is located between the fiber web and the cooled second band, respectively.

The invention relates further to an apparatus for drying a fiber web, the apparatus comprising a cylinder drying unit, which comprises several drying cylinders, the fiber web being pressed against the surface of the heated drying cylinders with a felt or a wire, and a band drier unit, which comprises two endless air impermeable bands, first turning rolls, the first band being arranged to turn around the first turning rolls, and second turning rolls, the second band being arranged to turn around the second turning rolls, whereby the first band and the second band are arranged to run part of the way parallel with each other so that they form a drying zone between them, the first band being arranged to be heated by heating means and the second band being arranged to be cooled by cooling means, and whereby the fiber web and at least one felt or wire are led between the bands in such a way that the fiber web is in contact with the heated first band, and the felt or the wire is located between the fiber web and the cooled second band, respectively.

Drying a fiber web between two parallel metal bands moving in the same direction in such a way that the fiber web is in contact with the heated metal band and a wire is located between the fiber web and the second cooled metal band so that the steam separated from the fiber web caused by the heating condenses to the wire by the effect of the cold metal band, is known from several patent publications, from which can be mentioned International Patent Application WO 96/11300 which is FI 95/00559 and U.S. Pat. No. 4,461,095, for instance. The operation is based on that two endless metal bands are arranged to run around turning rolls and pressure chambers containing hot steam and water, respectively, are provided against the inner surface defined by the loops formed by the bands so that the pressure produced presses the hot and the cold band, and respectively, the fiber web and the wire between them towards each other. The bands located between the pressure chambers form by means of seals one side for the pressure chambers so that the steam and water can directly affect the bands. The operation of the apparatus is fully known per se and has been disclosed for instance in the above patent publications, which are incorporated herein by reference.

In a cylinder drying unit, a fiber web is dried by means of several drying cylinders. The drying cylinders are heated and the fiber web is pressed against the surface of a drying cylinder with a felt or a drying wire. However, a drawback of using only a cylinder drying unit arises from the big size, high purchase price and high operating costs of the drying unit, for instance. Further, in a cylinder drying unit, the fiber web may shrink a lot in the transverse direction. Another drying arrangement is presented in which the fiber web is initially led to be dried between two moving, heated and cooled metal bands, and subsequently, to the cylinder drying unit in order to prevent the fiber web from curling, for instance. Such an arrangement takes a lot of room, however, and for that reason, for instance building costs will rise high. Likewise, it is difficult to arrange the conveying of the fiber web. Further, it is rather difficult to affect the control of fiber web properties in such arrangements.

The object of the present invention is to provide a method and an apparatus, by means of which the fiber web can be dried quickly, advantageously and effectively.

The method according to the invention is characterised in that the cylinder drying unit and the band drier unit are placed one above the other.

Further, the apparatus according to the invention is characterised in that the cylinder drying unit and the band drier unit are placed one above the other.

An essential idea of the invention is that a fiber web is dried by means of a drying unit, comprising two parallel bands moving in the same direction, in such a way that the fiber web is in contact with the heated band and a wire is located between the fiber web and the second cooled band so that the steam separated from the fiber web caused by the heating condenses to the wire by the effect of the cooled band, and additionally, by means of a cylinder drying unit, and that said units are placed one above the other. Moreover, the idea of a preferred embodiment is that the cylinder drying unit is arranged in such a way that the fiber web can be led from several different places of the cylinder drying unit to the other drier unit. The idea of still another preferred embodiment is that the fiber web can be led to several different points of the cylinder drying unit.

An advantage of the invention is that a considerable space saving is achieved by placing the drying units one above the other and the building costs remain rather moderate. A drier provided with moving bands can even be positioned at an old paper machine, above or below an existing cylinder drying unit, which makes it possible to utilize possibly existing cellar or attic rooms, thus achieving very advantageous building costs. Moreover, for instance in repair or maintenance situations, the fiber web can be led in a rather simple way through one of the drying units only, whereby it is not necessary to stop the paper machine, though the other drying unit is not in use. By arranging fiber web inlets and outlets at different places of the cylinder drying unit, it is possible to control and vary the properties of the fiber web to be dried in a very easy and simple manner.

The invention is described in greater detail in the attached drawings, in which

Figure 2:
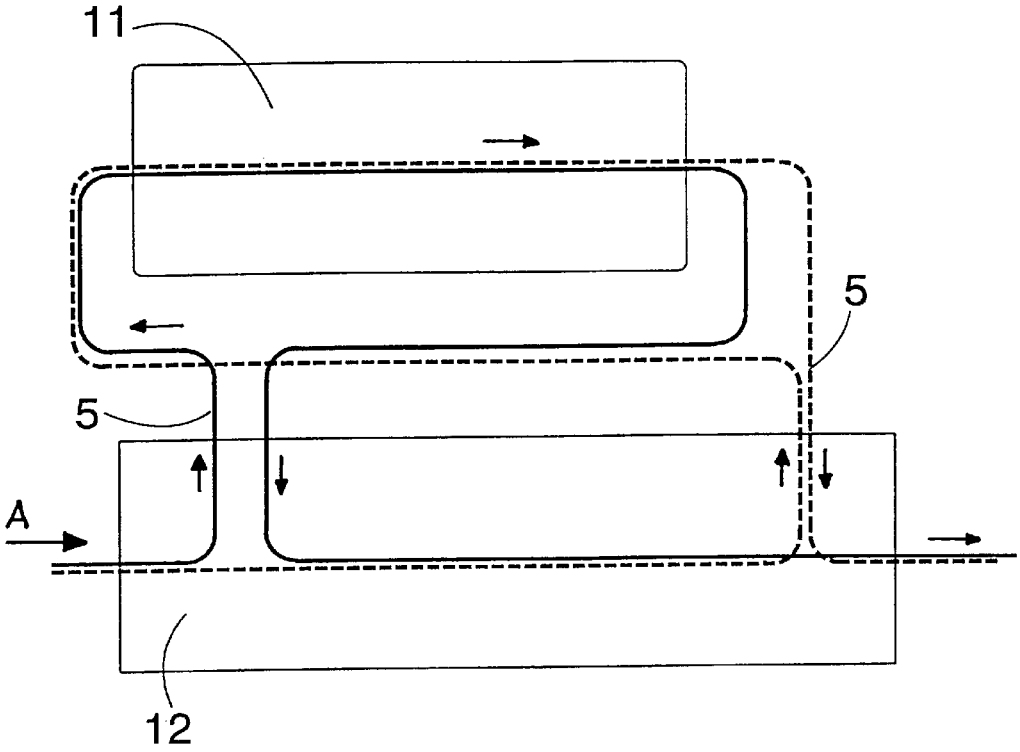
Figure 3:
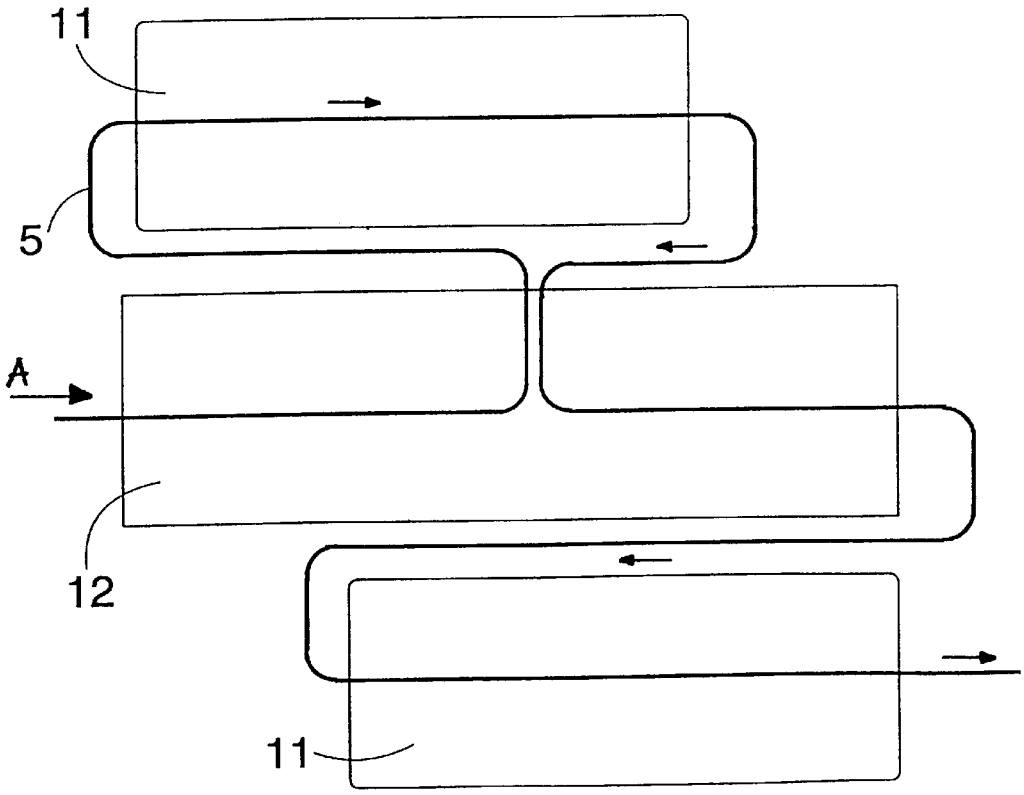

FIG. 1 shows a schematic sectional side view taken in the travel direction of the web and illustrating an apparatus for drying a fiber web according to the invention, FIG. 2 shows schematically an application of the apparatus of FIG. 1, when different ways of conveying the fiber web are used, and FIG. 3 shows a schematic sectional side view taken in the travel direction of the web and illustrating another apparatus for drying a fiber web according to the invention.

FIG. 1 is a schematic sectional side view taken in the travel direction of a web and illustrating an equipment according to the invention. The arrangement comprises a drier unit formed by endless bands that are impermeable to air, conduct heat well and are preferably made of metal: viz. a first band 1, i.e. an upper band, and a second band 2, i.e. a lower band, a fine wire or felt 3, a coarse wire 4 and the fiber web 5 running between those surfaces of the bands that face each other. The fiber web 5 moves in the direction indicated by arrow A. The first band 1 is arranged to turn around first turning rolls 6*a* and 6*b* located at the ends of the drier unit. Correspondingly, the second band 2 is arranged to turn around second turning rolls 7*a* and 7*b* also located at the ends of the drier unit, below the first turning rolls 6*a* and 6*b*. The wires 3 and 4 are supported and guided by guide rolls 8. Since the pressure prevailing in the drying zone in the area between the bands 1 and 2 is usually different from the pressure prevailing outside or on the sides of the bands 1 and 2, seals are arranged on both sides of the unit between or at the edges of the bands 1 and 2, the seals preventing liquid or gas from moving out of the area between the bands 1 and 2 sidewards, or vice versa. To effect vapor heating required for the drying, the drier unit comprises a pressure chamber 9, which is located above the first band 1. The first band 1 is sealed with seals 9*a* to the body 9*b* of the pressure chamber 9 so that the steam in the pressure chamber 9 remains at a suitable pressure. Below the second band 2 there is a water chamber 10 containing water that cools the second band 2. At the edges of the water chamber 10, there are seals 10*a*, with which the second band 2 is sealed to the body 10*b* of the water chamber 10. In this application, this drying unit is called a band drier unit 11.

The operation of the band drier unit 11 is based on heating the first band 1, which is in contact with the web 5, by hot steam contained in the pressure chamber 9. Then the temperature of the first band 1 causes that the water in the web 5 is vaporized and transferred through the wires 3 and 4 toward the second band 2. The second band 2, in turn, is continuously cooled with water located below it, whereby the steam produced on its surface condenses into water and is removed with the band 2 and the wire 4.

The apparatus further comprises a cylinder drying unit 12 comprising drying cylinders 13, against the surface of which the fiber web 5 is pressed with a felt or a drying wire for drying the fiber web 5 in a manner known per se. For the sake of clarity, FIG. 1 does not show the wires by which the fiber web 5 is pressed against the drying cylinders 13 of the cylinder drying unit 12 and by which the fiber web 5 is guided in the drying unit.

The band drier unit 11 and the cylinder drying unit 12 are placed one above the other. The costs of building such an arrangement are low and the arrangement can be utilized for instance in connection with an existing cylinder drying unit 12 by placing one band drier unit 11 above or below the cylinder drying unit 12. There is often room above or below the cylinder drying unit 12 or it is relatively easy to arrange room for the band drier unit 11. This placing one above the other also results in the advantage that, in a maintenance or repair situation, the fiber web 5 can easily be led through one drying unit only, whereby the production can go on, though the other drying unit is not in use.

In the apparatus of FIG. 1, the fiber web 5 is arranged to run in such a way that it is initially led to the cylinder drying unit 12 and, approximately in the middle thereof, the fiber web 5 is led to the band drier unit 11. Then the dry content of the fiber web 5 can typically be 55 to 75%. From the band drier unit 11, the fiber web 5 is returned to the cylinder drying unit 12 approximately in the middle thereof. Thus the smoothness of the fiber web 5 can be improved, the drying can be intensified and the dry content profile improved by means of the band drier unit 11. By bringing the fiber web 5 from the band drier unit 11 approximately to the middle of the cylinder drying unit 12, it is possible to correct the single-sided moisture distribution and curling tendency of the fiber web 5 and to perform additional processing of the fiber web 5, such as surface sizing, intermediate calendering or pigmenting.

In the cylinder drying unit 12, drying can also be performed single-sidedly and the fiber web 5 having single-sided dry content can be led to the band drier unit 11, which makes it possible to affect the surface properties of the fiber web 5 and to control the curling tendency of the fiber web 5. Surface properties can also be affected by moisturing the surface of the fiber web 5 just before the band drier unit 11.

FIG. 2 shows different alternative ways of conveying the fiber web 5 in connection with the apparatus of the invention. For the sake of clarity, no detailed structures of the band drier unit 11 and the cylinder drying unit 12 are shown in FIG. 2 and, also for the sake of clarity, the route of the fiber web 5 is shown only approximately. Travel directions of the fiber web 5 are illustrated by arrows. Leading the fiber web 5 from the beginning of the cylinder drying unit 12 to the band drier unit 11 and further from the band drier unit 11 back to the beginning of the cylinder drying unit 12 is shown by a solid line. Then the fiber web 5 is conveyed into the band drier unit 11 in a rather moist state, whereby the dry content of the fiber web 5 can typically be 35 to 55%, for instance. In this case, it is possible to influence the properties of the fiber web 5 by means of the band drier unit 11 rather effectively. The fibers of a moist fiber web have maximum workability and adaptability, which makes it possible to influence the surface properties of the fiber web 5 and, on the other hand, the bonding of the fiber material effectively. Simultaneously, a transverse shrinkage of the fiber web 5 can be prevented at a critical stage of drying by means of the band drier unit 11, which means that the transverse mechanical properties of the fiber web 5 can be influenced most effectively. When desired, the fiber web 5 can instantly be conveyed directly to the band drier unit 11 and from there to the beginning of the cylinder drying unit 12. By conveying the fiber web 5 from the band drier unit 11 to the beginning of the cylinder drying unit 12, the drying capacity can be increased very remarkably.

A broken line shows an alternative in which the fiber web 5 is at first led through the cylinder drying unit 12 and from the end part thereof through the band drier unit 11 and further from the band drier unit 11 to the end part of the cylinder drying unit 12. When the fiber web 5 is brought to the band drier unit 11, its dry content can typically be 75 to 85%. Then the smoothness of the fiber web 5 can be improved in the band drier unit 11 or the band drier unit 11 can be used for intensifying the drying and for improving the dry content profile. Further, after the band drier unit 11, corrections of curling and additional processing of the fiber web 5, such as coating and calendering, can be performed in the end part of the cylinder drying unit.

When the cylinder drying unit 12 and the band drier unit 11 are placed one above the other, the conveying of the fiber web 5 from the cylinder drying unit 12 to the band drier unit 11 and from the band drier unit 11 back to the cylinder drying unit can be arranged easily at desired places practically along almost the whole cylinder drying unit. It is then possible to affect the results to be obtained in connection with drying the fiber web 5 in a desired manner, which means that it is rather easy to manufacture a plurality of products deviating from each other rather much by means of one equipment.

FIG. 3 is a schematic sectional side view taken in the travel direction of the web and illustrating another apparatus according to the invention. For the sake of clarity, FIG. 3 also shows the band drier units 11 and the cylinder drying unit 12 without structures in detail. Also the movement of the fiber web 5 is shown only approximately and its travel directions are illustrated by arrows. A band drier unit 11 is placed both above and below the cylinder drying unit 12. In this way, still more possibilities of determining properties of the fiber web 5 are achieved. The band drier units 11 can also be arranged for instance in such a way that one of them is drying the fiber web 5 on the surface side and the other one on the side opposite to that, which gives the fiber web 5 a uniform quality.

The drawings and the description relating to them are only intended to illustrate the idea of the invention. As far as the details are concerned, the invention may vary within the scope of the claims. So it is not essential which pressure medium is used in the pressure chamber 9 and the water chamber 10. The medium of the pressure chamber 9 can thus be steam, air, or hot combustion products of fuel, or water, for instance. In addition to water, also for instance air can be used as medium in the water chamber 10.

In addition to the heating caused by the pressure chamber 9, the first band 1 can also be heated at other places in manners fully known per se. Further, the heating of the first band 1 can take place entirely outside the pressure chamber 9 or the drying of the fiber web 5 can even take place without a pressure chamber 9.

Moreover, the second band 2 can also be cooled outside the water chamber 10 or the cooling can be implemented without a water chamber 10 in manners fully known per se.

For instance two band drier units 11 can also be arranged one after the other and one of them can be arranged to dry the surface side and the other one the rear side of the fiber web 5.

We claim:

1. Method of drying a fiber web, in which method the fiber web is dried by means of a cylinder only drying unit, by pressing the fiber web against the surface of a drying cylinder with a felt or a drying wire, and in a band drier unit, comprising two endless air impermeable bands, first turning rolls, the first band being arranged to turn around the first turning rolls, and second turning rolls, the second band being arranged to turn around the second turning rolls, whereby the first band and the second band are arranged to run part of the way parallel with each other so that they form a drying zone between them, the first band being heated and the second band being cooled and whereby the fiber web and at least one felt or wire are led between the bands in such a way that the fiber web is in contact with the heated first band, and the felt or the wire is located between the fiber web and the cooled second band, respectively, wherein the cylinder drying unit and the band drier unit are placed one above the other.

2. Method according to claim 1, wherein the fiber web is initially led to the cylinder drying unit, from where it can be led to the band drier unit from several places of the cylinder drying unit.

3. Method according to claim 1, wherein the fiber web is led from the band drier unit to the cylinder drying unit, to which the fiber web can be led from several different places of the cylinder drying unit.

4. Method according to claim 1, wherein the fiber web is dried by means of at least two band drier units.

5. Apparatus for drying a fiber web, the apparatus comprising a cylinder only drying unit, which comprises several drying cylinders, the fiber web being pressed against the surface of heated one of the drying cylinders with a felt or a wire, and a band drier unit, which comprises two endless air impermeable bands, first turning rolls, the first band being arranged to turn around the first turning rolls, and second turning rolls, the second band being arranged to turn around the second turning rolls, whereby the first band and the second band are arranged to run part of the way parallel with each other so that they form a drying zone between them, the first band being arranged to be heated by heating means and the second band being arranged to be cooled by cooling means and whereby the fiber web and at least one felt or wire are led between the bands in such a way that the fiber web is in contact with the heated first band, and the felt or the wire is located between the fiber web and the cooled second band, respectively, wherein the cylinder drying unit and the band drier unit are placed one above the other.

6. Apparatus according to claim 5, wherein the fiber web is arranged to be led initially to the cylinder drying unit and can be led from several different places of the cylinder drying unit to the band drier unit.

7. Apparatus according to claim 5, wherein the fiber web can be led from the band drier unit to several different places of the cylinder drying unit.

8. Apparatus according to claim 5, wherein the apparatus comprises at least two band drier units.

* * * * *